United States Patent [19]

Gorlov

[11] Patent Number: 4,759,655

[45] Date of Patent: Jul. 26, 1988

[54] TERRORIST VEHICLE ARRESTING SYSTEM

[75] Inventor: Alexander M. Gorlov, Chestnut Hill, Mass.

[73] Assignee: Flexible Barricades Inc., Watertown, Mass.

[21] Appl. No.: 63,150

[22] Filed: Jun. 16, 1987

[51] Int. Cl.[4] ..... E01F 13/00

[52] U.S. Cl. ..... 404/6; 49/9; 49/34

[58] Field of Search ..... 404/6, 9, 10; 256/1, 256/13.1; 49/9, 34, 49, 141; 244/110 R, 110 C; 52/174

[56] References Cited

U.S. PATENT DOCUMENTS

| | | | |
|---|---|---|---|
| 1,437,404 | 12/1922 | Donovan | 49/34 |
| 1,628,651 | 5/1927 | Burress | 49/9 |
| 1,663,152 | 3/1928 | Baeth | 404/6 X |
| 1,748,563 | 2/1930 | Strauss | 49/9 |
| 1,828,296 | 10/1931 | Sawyer | 49/9 |
| 1,848,516 | 3/1932 | Davison | 49/9 |
| 1,848,517 | 3/1932 | Davison | 49/9 |
| 2,295,205 | 9/1942 | Fraser | 49/9 |
| 2,435,919 | 2/1948 | Banschbach | 404/6 X |
| 2,675,197 | 4/1954 | Hospers | 49/9 X |
| 3,013,750 | 12/1961 | Fonden et al. | 49/9 X |
| 3,292,909 | 12/1966 | Bianchi | 256/13.1 |
| 4,576,507 | 3/1986 | Terio | 404/6 |
| 4,645,375 | 2/1987 | Carney, III | 404/6 |

*Primary Examiner*—Stephen J. Novosad
*Assistant Examiner*—John F. Letchford
*Attorney, Agent, or Firm*—Robert K. Tendler

[57] ABSTRACT

A terrorist vehicle arresting system includes a crash barrier positioned at a side of a driveway instead of across the driveway; a gate across the entranceway which is dislodged by a vehicle coming through the closed gate; a net pulled out by the dislodged gate which captures the vehicle; a capstan to pivot a captured vehicle into the barrier; and cables from the net looped around the capstan, such that the netted vehicle is swung into the barrier where it comes to rest blocking the driveway. The impact-force is therefore redirected from the direction of the driveway, and the kinetic energy is dissipated upon impact with the offset, rigid barrier, thereby permitting the gate structure to be made light, aesthetically attractive, and quickly closed since the gate does not have to bear any substantial load. In a preferred embodiment, the crash barrier is positioned in such a location with repect to the driveway that the stopped vehicle lying in the driveway blocks further vehicles from continuing down the driveway.

11 Claims, 7 Drawing Sheets

TERRORIST VEHICLE ARRESTING SYSTEM

FIELD OF INVENTION

This invention relates to a method and apparatus for thwarting terrorist attempts at unauthorized gate penetration, and more particularly to a system for arresting vehicles which is capable of withstanding high impacts while, at the same time, preventing penetration.

BACKGROUND

In the past there have been various vehicle barriers placed directly across roadways to prevent vehicle penetration. One of the difficulties associated with such barriers is that the barrier must be removeably placeable across a roadway. Thus the barrier must be massive enough to arrest a vehicle, yet light enough to be removed for regular vehicular traffic. In order to provide the above functions light weight barriers have been substituted for massive barriers but these light weight barriers have required expensive and somewhat unreliable cable brakes or shock absorbing systems so that the light weight barrier will not break on impact. Such a system is illustrated in U.S. Pat. No. 4,576,507, in which a barrier is released to come down over a gate to attempt to stop a high-speed vehicle. In this case, the barrier is prevented from breaking by virtue of expensive and unwieldy hydraulic or spring-loaded shock absorbers.

By way of further background, in the past, various flexible railroad crossing gates and highway guard fences such as illustrated in U.S. Pat. Nos. 1,848,516; 1,848,517; and 3,292,909 have also utilized various types of shock-absorbing mechanisms which include brakes on drums or other hydraulic and spring-loaded systems. These are likewise complicated and expensive. Note that yieldable barriers have been used for traffic and include U.S. Pat. Nos. 2,295,205 and 1,828,296 which also involve cable and drum-type braking systems. Flexible impact-barriers are illustrated, for example, by U.S. Pat. No. 4,645,375 and a device for arresting airplanes which includes a net that has a shock-absorbing device including a braking system is illustrated in U.S. Pat. No. 3,013,750. Finally, U.S. Pat. No. 1,748,563 illustrates a flexible obstruction-device extending across an open driveway to prevent access by gradually bringing an automobile to a stop at a right-of-way, street, or other crossing. Means are provided for retarding the paying out of the cables connected to the obstructing device which includes a braking mechanism consisting of frictional plates arranged to retard the paying out of the cable.

SUMMARY OF THE INVENTION

In contradistinction to all of the above methods of arresting a vehicle traveling along a given direction, in the Subject System, a vehicle is deflected from its direction of travel through the utilization of a net which captures the vehicle from the front and side and swings it along an arc tangent to the center line of the driveway, thereby redirecting the vehicle such that the kinetic energy is dispersed, not by any retarding mechanism or the resilient qualities of the retarding device, but by the utilization of a pivot in the form of a capstan which is offset from the driveway, and finally by an impact embankment.

The redirection of the inertial force of the oncoming vehicle dissipates the kinetic energy and swings the vehicle into a position where it is made to crash against the embankment, preferably of relatively soft material reinforced by railroad ties held together by cables. The enbankment by which the vehicle is stopped is offset from the driveway, thereby not precluding entrance for authorized vehicles. However, the barrier is preferably positioned so as to stop the vehicle such that the stopped vehicle becomes immeidately itself a barrier to other follow-along vehicles attempting to pass through the originally violated gate structure.

In a preferred embodiment, the gate, whether it be raised, lowered, slid, or swung into position is carried away by the impact of the oncoming vehicle, with the cables being utilized to connect the net to the capstan also being anchored to the gate as well as to the net. In one embodiment, the net is connected to the gate via the cables going around the capstan, with the net being attached to the gate and cables with a four-point coupling system. In a preferred embodiment the net is stored at one side of the driveway in a box or pillar post container.

The purpose of the gate is to make use of the force of the vehicle to cause the stored net to be pulled out along the side of the vehicle as it progresses because the gate is connected to the leading edge of the net by cables or other means.

During normal operation, the netting utilized to capture the vehicle is stored in the above-mentioned side pillar post and the cables utilized to connect the corners of the net together around the capstan are either in ground-level channels for the lower cable portions or are carried over the top of the gate for the upper cable portions so that regular vehicle traffic can be maintained through the gate when opened. The cables are connected to eyelets in the corners of the net and also to the gate via four coupling cables or equivalent clamping devices.

Upon the encroachment of an unauthorized vehicle, the gate is closed rapidly, with the rapid closure of the gate being made possible by its light-weight construction since the gate itself is meant to be detachable upon impact and only provides for a barrier against human traffic as opposed to vehicular traffic.

Because the cables are coupled to the break-away gate, with the carrying away of the gate upon impact, the encroaching vehicle carries with it the forward end of the net which entraps the front end of the truck, bulldozer, or other vehicle at its front, and this pulls the rest of the net which encapsulates the side of the vehicle away from the capstan. This causes the vehicle to be netted and carried or swung in a circular direction around the capstan where it is made to crash, or at least stopped against a barrier which is to one side of the driveway. In one embodiment, the barrier against which the vehicle is made to stop is positioned such that the vehicle is stopped so that its remains impede or block further traffic through the driveway. The preferable material for the barrier is a soft material, such that debris is not spewn over the entire area.

In contradistinction of the above-mentioned patents, no crash barriers are placed across the roadway. Moreover, no braking or shock-absorbing equipment is necessary, with the kinetic energy of the vehicle being dissipated by virtue of its swing through an arc and into a bank or rigid barrier. This makes possible the utilization of a knotless, braided-nylon netting such as manufactured by Bridport Gundrey Ltd. of Bridport, Sussex England. It will be appreciated that the breaking force of nylon ropes used in such a net is between ten and fifty tons, which braking force is in effect augmented by virtue of the capstan/cable/net system described above.

The subject kinetic energy redirection system can be utilized with a number of break-away gates including two swingable gates each swung from an opposite pillar post, a sliding gate, or a single swingable gate. Additionally, any other type of gating structure which is carried away by the vehicle may be utilized. For instance, one type gate is in the form of a collapsible parallelogram, which when in its "down" or "closed" position has interlocking hook and eye latches which are effective in maintaining the gate together until such time as the vehicle is trapped by the aforementioned net/cable/-capstan system.

In another embodiment, a specialized sliding gate is used which is supported by trolleys on an upper channel that also houses the upper cables. The gate structure is such that the cables do not move relative to each other with the sliding of the gate. Upon impact, the sliding gate and its associated cables come out of the channels and are carried away with the front of the impacting vehicle.

In one embodiment, the upper and lower corners of the net are connected by a single cable which loops around the capstan. Thus, each cable constitutes a single loop connecting an upper and lower corner of the net. Alternatively any two corners of the net can be connected together by the single loop. The location of the cables above and below the gate permits regular traffic flow because the traffic merely runs over the lower cable portions, whereas the top cable portions are sufficiently high such that normal vehicular traffic is accommodated.

In a preferred embodiment, the break-away gate is slightly ahead of the cables which lie at the surface of the driveway such that upon impact, one portion of the leading lower cable is behind the wheels of any oncoming vehicle at impact. This ensures the entrapment of the vehicle in the net and the swinging of the vehicle to one side by virtue of the capstan/cable/net combination. The cables may also be fixed in attachment to the the capstan so as to cause a change between the upper and lower lengths of these cables during curvilinear travel of the vehicle as some or all of the cables wrap around the capstan.

In one embodiment, the capstan is provided with an exceptionally wide top portion to prevent the cables from slipping off the top. Alternatively, the capstan may be provided with a ring or collar. The collar may include eyelets or idlers through which the cables pass. The collar rotates around the capstan during an impact, with forces between upper and lower cable being adjustable through the idlers or through slippage of the cables either around the capstan or through the eyelets or the collar itself.

In summary, a terrorist vehicle arresting system includes a crash barrier to one side of a driveway instead of across the driveway; a gate quickly closed across the entrance way which is dislodged by a vehicle coming through the closed gate; a net pulled out from a side storage bin by the dislodged gate which captures the vehicle; a capstan which serves as a pivot for the captured vehicle; and cables from the net looped around the capstan, such that the netted vehicle is swung into the barrier where it comes to rest blocking the driveway. Thus, the Subject System does not require the energy absorbing barrier to be positioned across the driveway and provides for the arrest of the intruding vehicle without cumbersome and expensive shock-absorbing systems and prevents the spewing forth of debris over a wide area. In one embodiment top and bottom corners of the net are coupled together by the cables which go around the capstan. Alternatively, any pairs of corners of the net may be coupled together by a cable which goes around the capstan. Note that the corners of the net are joined together by a border cord or cable which goes through the net along its periphery. The net/capstan/barrier system thereby redirects the initial reaction force by changing the direction of the motion of the vehicle so that the vehicle is fully arrested by the stationary elasto-rigid structure without the use of shock absorbers for the cables or cable brakes. The kinetic energy is thus dissipated upon impact with the offset, rigid barrier, thereby permitting the gate structure to be made simple and light, aesthetically attractive, and quickly moved into a closed position since the gate does not have to bear any substantial load. Unique, in one embodiment, is the use of a capstan collar and/or pulleys or idlers for the instantaneous adjustability of the net's upper and lower cable lengths. Also, the cables leading to the capstan may be attached to the collar carried by the capstan so that the cables will not slip off the capstan. In one embodiment, the net is stored at one side of the driveway gate and is drawn along side the vehicle from a storage-bin by the impacted gate when the front of an oncoming vehicle comes into contact with the gate which is carried away due to the impact of the vehicle with the gate structure. In another embodiment, the gate's grill work or net gives way allowing the frame of the gate to trap the vehicle when the vehicle impacts the gate, such that the wheels of the vehicle have already passed over this frame. In a preferred embodiment, the crash barrier is made soft and is positioned in such a location with respect to the driveway that the stopped vehicle lying in the driveway blocks further vehicles from continuing down the driveway. In a still further embodiment, either the gate is of a collapsed parallelogram type, or of a sliding type in which the sliding gate and cables come out of respective upper and lower tracks upon vehicle impact.

BRIEF DESCRIPTION OF THE DRAWINGS

These and other features of the subject invention will be better understood in connection with the Detailed Description taken in conjunction with drawings of which.

DETAILED DESCRIPTION

Figure 1A:
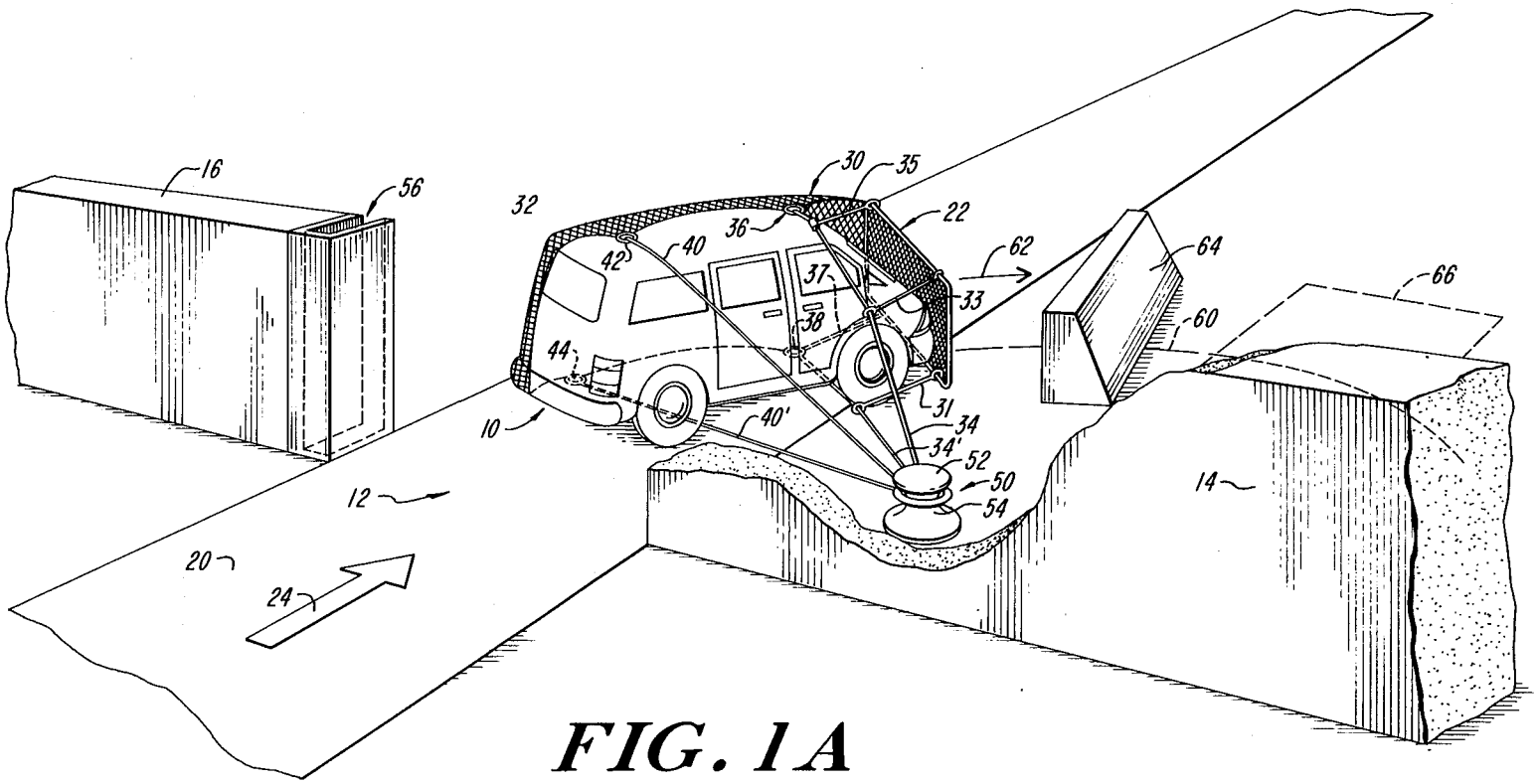
FIG. 1A is a diagrammatic illustration of the entrapment of a vehicle going through a gate by virtue of a side-catching net and an offset rigid barrier along with an offset capstan which serves as a captured vehicle pivot.
Figure 1B:
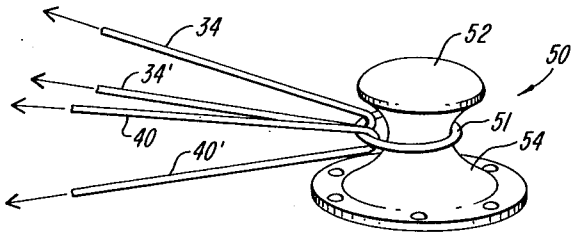
FIG. 1B is a diagram of the capstan for use in the FIG. 1A system, illustrating a ring or collar through which the cables of FIG. 1A pass.

Referring now to FIG. 1A, a vehicle 10 is shown to have passed through a gateway generally indicated by reference character 12. Adjacent walls 14 and 16 surround the gateway opening and a driveway 20 is shown passing through the gateway. As illustrated, vehicle 10 has broken through the gateway and carries with it a dislodgeable gate 22 which is normally positioned across the gateway. Here the direction of travel of the vehicle is illustrated by arrow 24. As can be seen, gate 22 carries with it a net generally indicated by reference character 30 to surround a side 32 of vehicle 10, with the net having a leading cable with proportions 34, 34' forming a loop joining a forward or leading upper corner 36 of the net 30 with a forward lower corner 38 of the net. Cable portions 34 and 34' are shown schematically to be joined to four corners of the gate via cables 31, 33, 35 and 37. The trailing portion of the net is secured by a cable having proportions 40, 40' that form a loop which joins a trailing or aft upper corner 42 of the net with a trailing or aft lower corner 44 of the net. It will be appreciated that the cables are looped around a capstan generally indicated by reference character 50, which has a top portion 52 and a smooth, thimble-shaped interior barrel or surface 54 about which the cables are adapted to either slip or move with the rotation of the barrel of the capstan should the barrel be rotationally mounted to a base. For either the forward loop or the trailing loop cables, rotation of the capstan will be in the same direction to tighten the net about the vehicle. In general this means that the cable portion lengths will self-adjust to pull the top of the net over the vehicle. Slippage or self-adjustment between the top and bottom cable portions is important to balance the forces between the bottom and the top of the net. This automatically adjusts looseness between the top and bottom of the net. This is most readily accomplished by the idlers of the FIG. 7 embodiment. Note, in FIG. 1B cable portions 34, 34' and 40, 41' are coupled to capstan 50 via a ring or collar 51, with the slippage of these cables through the ring providing for the above cable length adjustment. The collar itself provides for pivoting about a vertical axis of the capstan.

Figure 1C:
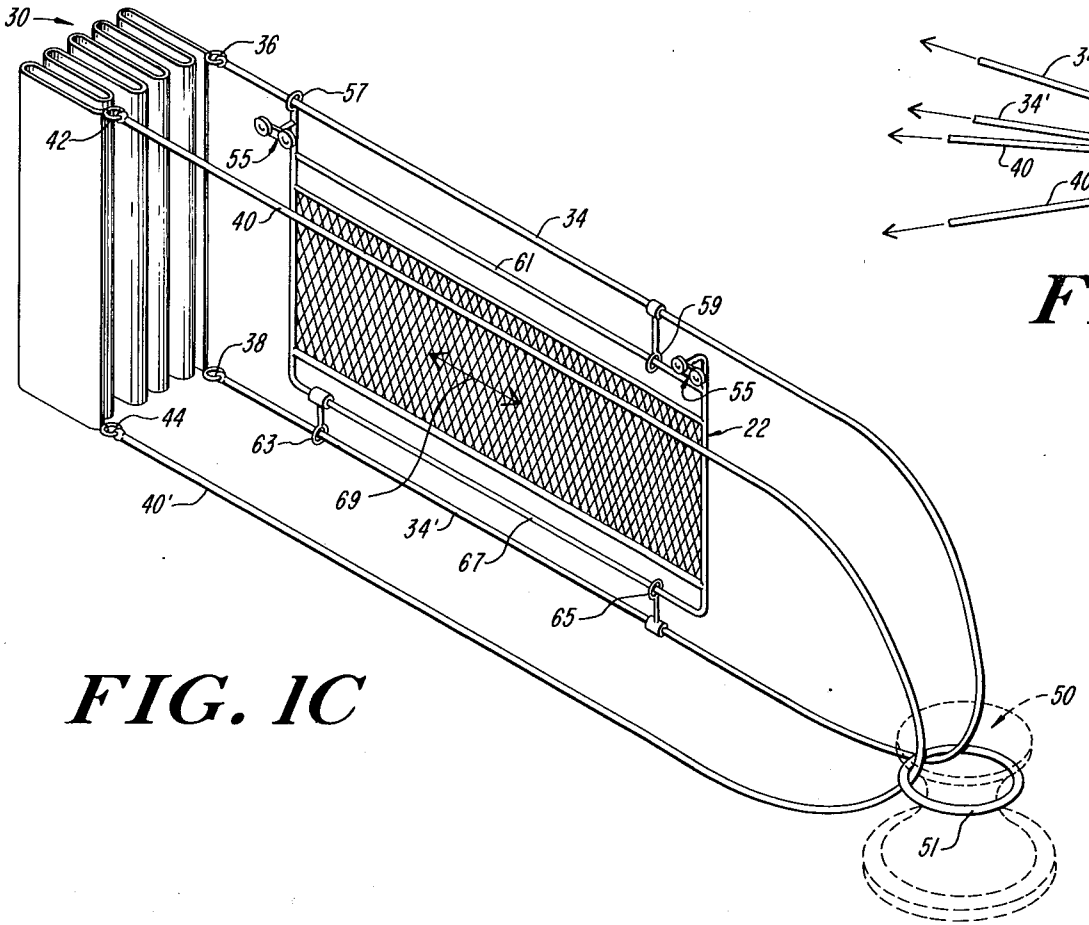
FIG. 1C is a diagrammatic representation of a sliding gate embodiment showing the attachment of the cables to the net, and a four-point attachment of the cables in the leading cable loop to the break-away gate.

Referring now to FIG. 1C, net 30 may be housed in folded form as illustrated, in which the leading eyelets 36 and 38 are joined by cable 34, 34' which forms a loop through ring 51 of capstan 50. It will be appreciated that sliding gate 22 includes trolleys 55 which roll along an upper channel (not shown in this figure) with the gate frame being attached to cable 34 via an eyelet 57 carried by trolley 55 and via an eyelet 59 carried by cable 34 which goes around a transverse bar 61 of the frame of gate 22. This in essence connects eyelet 36 of net 30 with the top portion of the break-away gate.

With respect to eyelet 38, this is connected via cable portion 34' to an eyelet 63 carried by a bottom portion of the frame of gate 22 and by an eyelet 65 which is carried on cable portion 34' and surrounds a transverse lower bar 67 of gate 22. This eyelet and trolley construction permits the sliding of gate 22 in the direction of double-ended arrow 69 without the removal of net 30 from its stored position as illustrated.

Figures 10, 12:
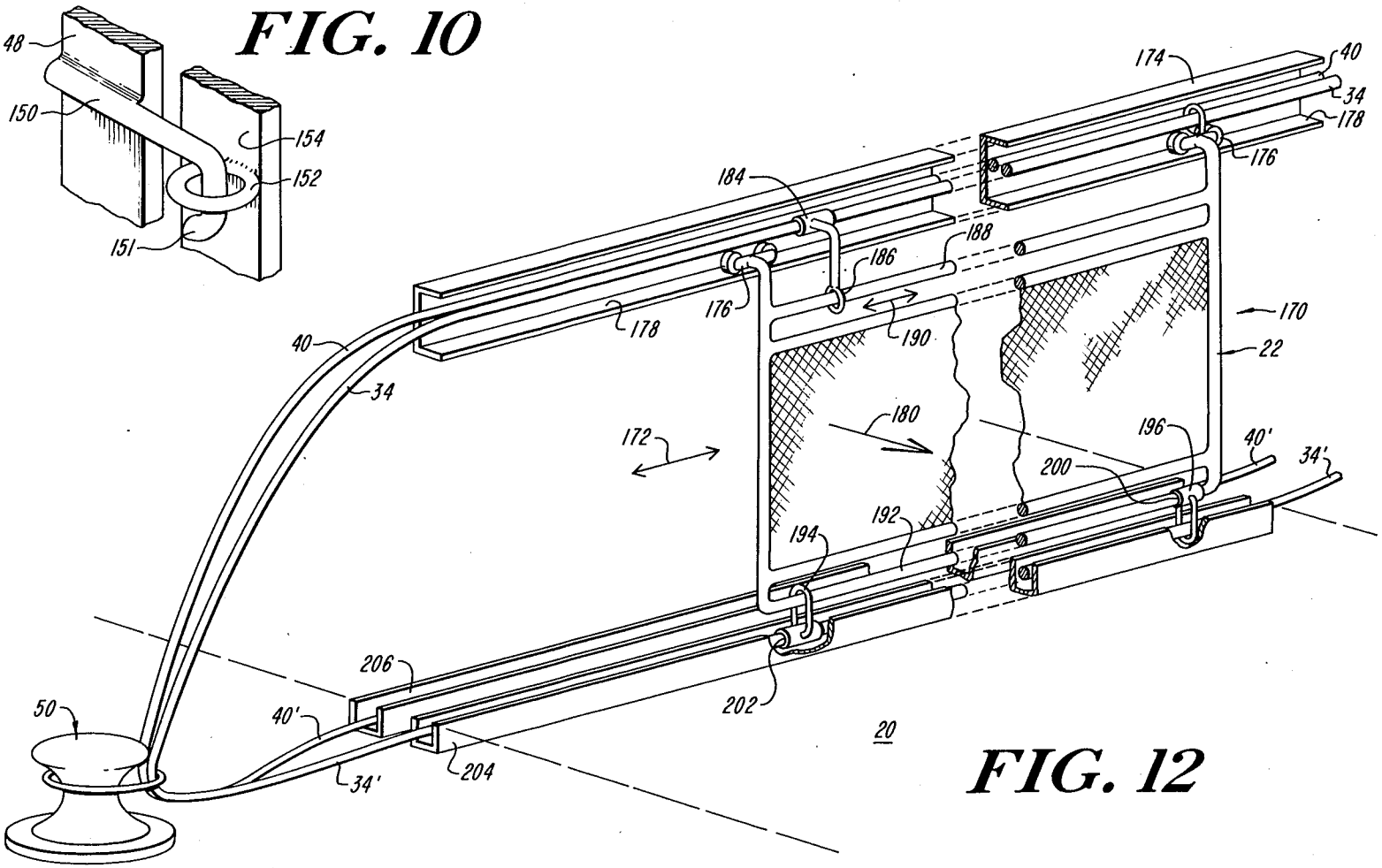
FIG. 10 is a diagrammatic illustration of one portion of the rigid hook and eye structure for use with the gate of FIG. 9.

Upon impact with a vehicle, however, the break-away gate pulls out of its respective tracks as illustrated in FIG. 12 to be described hereinafter, and pulls forward eyelets 36 and 38 which carry the leading edge of net 30 about the vehicle which is impacting the gate. The trailing edge of the net has afore-mentioned eyelets 42 and 44 coupled to cable portions 40 and 40' which again run in a loop through ring 51 on capstan 50. In this diagram it can be seen that the forward or leading edge of the net is coupled in a four-point connection system to the break-away gate via cable 34, 34', thereby establishing the four-point linkage system described in connection with FIG. 1A.

It will be noted that the net is generally rectangular in configuration, having upper and lower corners joined by cable portions 34, 34'; or cable portions 40, 40' respectively. This rectangular configuration constitutes a preferred embodiment, with other net configurations being within the scope of this invention.

In operation, and referring back to FIG. 1A, the vehicle 10 impacts gate 22 which causes net 30 to surround the vehicle as shown, with the net being pulled out of a storage container generally indicated at 56 by virtue of its being attached via cables to the gate carried away by an impacting vehicle. By virtue of the capstan and the netting, which can be a knotless net such as mentioned hereinbefore, the vehicle is swung in a circle illustrated by dotted line 60, such that the momentum of the vehicle initially along the center line of the driveway is now moved off axis as illustrated by arrow 62, such that the vehicle comes to rest against a barrier 64 which is to one side of the roadway, thereby dissipating the kinetic energy associated with the vehicle. Note the barrier face is preferably perpendicular to circle 60 for maximum effect. In one embodiment, barrier 64 is located adjacent the roadway so that the vehicle is stopped across the roadway, thereby preventing any further traffic through the gateway. Alternatively, the vehicle may be swung a whole 180 degrees around to wall 14 where it is allowed to smash up against the wall or some other barrier in a zone generally indicated by dotted line 66 which forms a debris disposal zone.

Note in one embodiment in which Kevlar cables are used, each portion of a cable loop is capable of withstanding 110,000 pounds of force. This translates into a total tensile strength of 440,000 pounds.

As can be seen, the operation of the system is such that upon impact, the gate becomes dislodged carrying the light-weight net which is stored to one side or the other of the gateway such that the net both captures the vehicle and swings it away from the driveway by virtue of the cables going around capstan 50. This changes the momentum by changing its direction, whereby all the force is dissipated upon impact with the barrier. It will be appreciated that the reason for the utilization of a net and capstan is to effectuate a momentum direction change which alleviates the problem of having hydraulic cylinders for net cables, or complicated braking mechanisms for the cables. It will be appreciated that barrier 64 can be a mound of earth surrounded by a cofferdam along with reinforcing railroad ties and cables such that the impact is softened, thereby to minimize the amount of debris thrown off.

Figure 2:
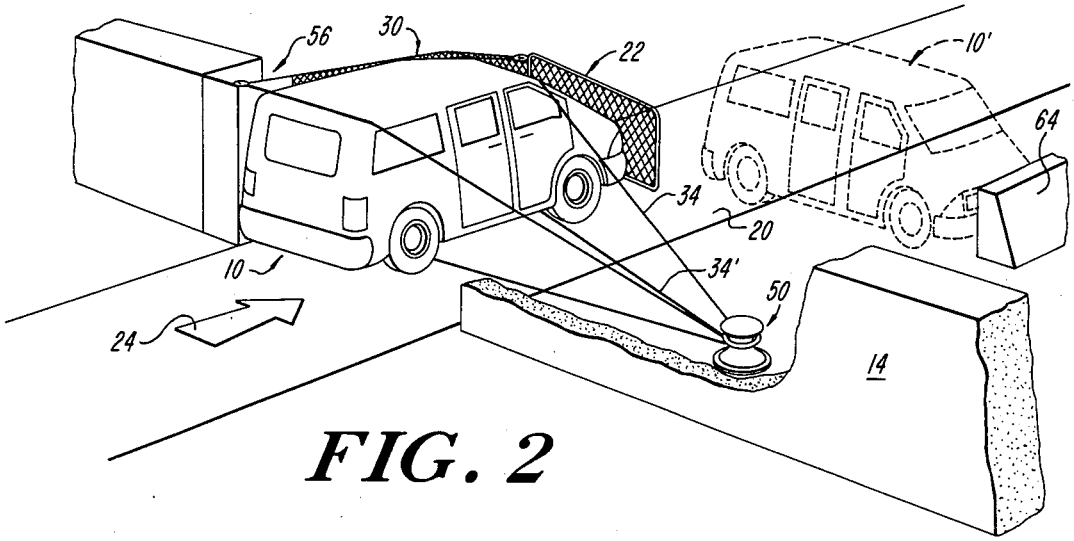
FIG. 2 is a diagrammatic illustration of initial impact of a vehicle with a gate which pulls the net out of a net container.

Referring now to FIG. 2, vehicle 10 is illustrated as having impinged upon gate 22, with gate 22 having been carried away from wall 14. Thence the vehicle proceeds to be pivoted about capstan 50 into barrier 64 which is to one side of driveway 20. In this case it can be seen that the upper cable portion 34, is lifted above the top of the vehicle 10 and pulls out the top of net 30 so as to encompass the top portion of vehicle 10. Simultaneously the lower cable portion 34' having been held in a channel in the driveway and at least its forward end having been run over by vehicle 10 pulls out the bottom of net 30 from container 56.

With the barrier just to one side of the driveway, the final position of vehicle 10 as illustrated in dotted outline 10' is such that it blocks driveway 20 and prevents any further vehicular traffic.

Figure 3:
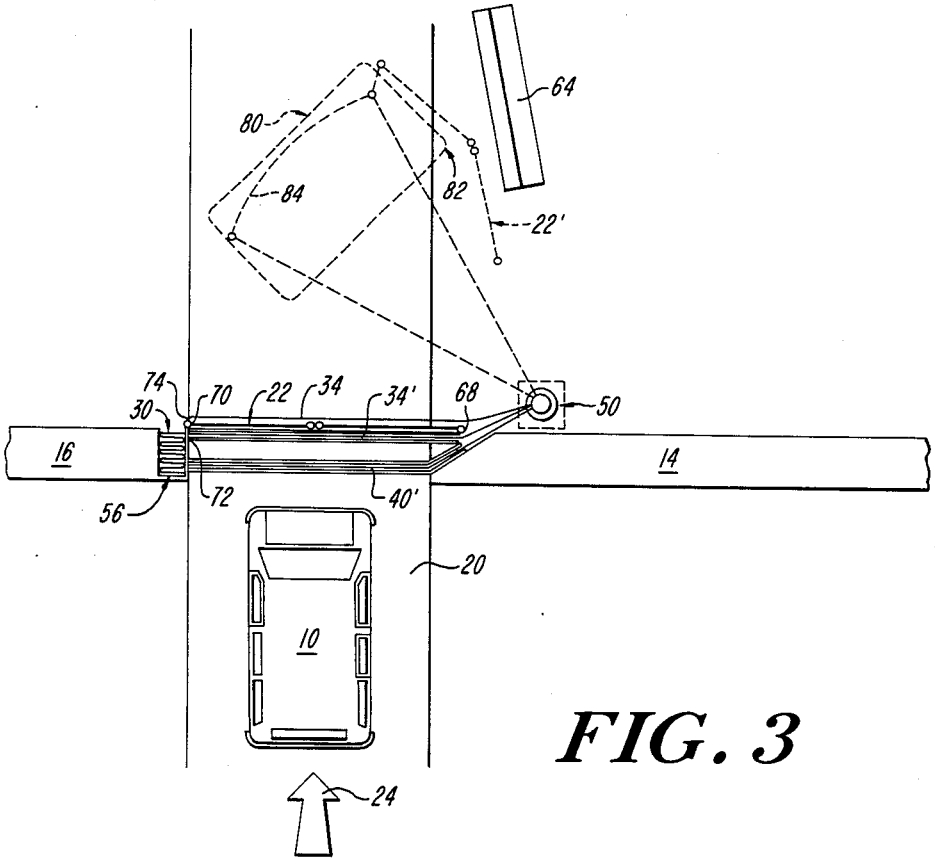
FIG. 3 is a diagrammatic top view of a vehicle approaching a gate with the net to one side, also showing the position of the vehicle after the break away of the gate showing the pull out of the net.

How this is accomplished is illustrated in FIG. 3 in which the lower cable portions 34', 40' are shown in channels in driveway 20. Here net 30 is held in container 56 in wall 16, with capstan 50 being on an opposite side of the driveway adjacent wall 14. As can be seen, lower cable portion 34' is anchored to gate 22 at points 68 and 70, whereas this cable is fixed to the lower leading corner of net 30 at point 72 adjacent point 70. The other end of this cable is joined to the upper leading corner of the net at point 74. As the vehicle 10 proceeds to crash through gate 22, and as illustrated at dotted line 80, break-away gate 22 is bent around at least a right front portion of the vehicle here illustrated at 82. At this juncture, net 30 has been pulled out of its container 56 as illustrated by dotted line 84 so that it begins to surround the front portion and the left side of the vehicle, when vehicle 10 is in position 80.

Figure 4:
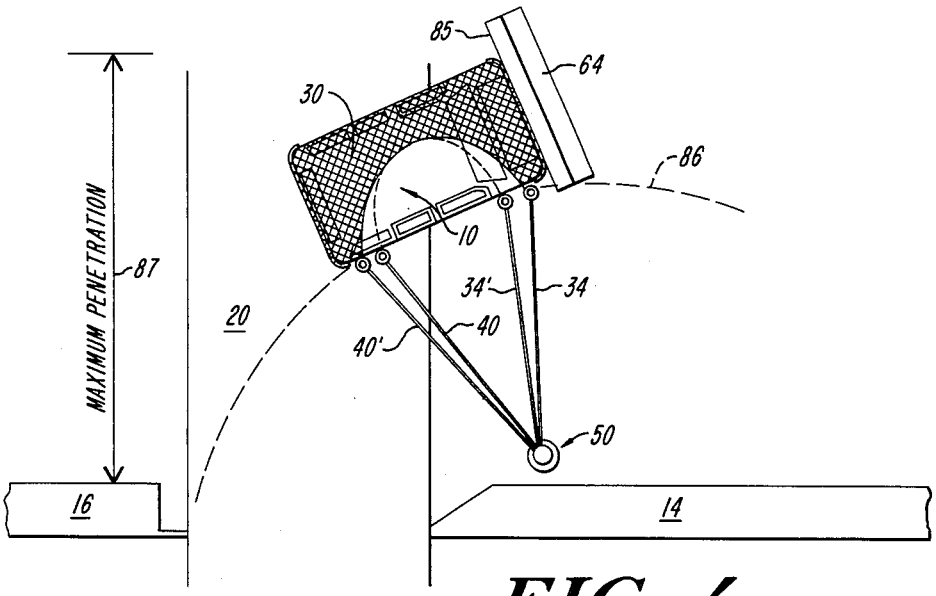
FIG. 4 is a diagrammatic top view of the swinging of the vehicle away from the roadway and into an offset barrier.

Referring now to FIG. 4 net 30 surrounds the vehicle as the vehicle impacts barrier 64, with the barrier in this case having a face 85 tangent to a circular path 86 along which the vehicle is swung. Here barrier 64 is close enough to the driveway that the vehicle comes to rest blocking the roadway. In this illustration cable portions 34, 34' and 40, 40' are connected to the respective top and bottom corners of the net as illustrated. Note, the maximum penetration is shown by arrow 87 and can be limited by moving the capstan closer to the roadway and shortening the respective cables.

Figure 5:
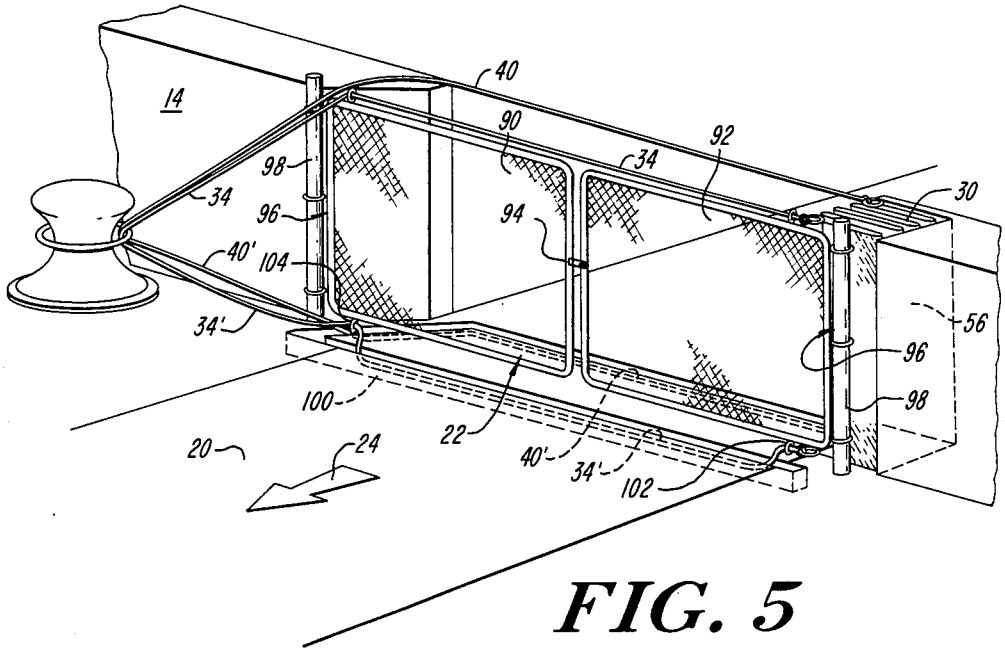
FIG. 5 is a diagrammatic illustration of a dual gate structure along with a capstan, illustrating the joinder of the cables to the net as well as to portions of the gate.

Referring now to FIG. 5, in one embodiment gate 22 may be a double-gate, light-weight, swingable structure having swingable gate portions 90 and 92 locked together by a latch 94, with the gate being hinged to walls 14 and 16 at breakable joints 96 mounted to upstanding pillars 98. Here it can be seen that net 30 is carried to one side of the gateway in container 56, with the bottom cable having its lower portion 34' within a channel 100 within driveway 20 where it is anchored at point 102 to gate 22 and also to the leading bottom corner of net 30. This cable may also be attached to the left hand side of the gate at a point 104 such that when the gate is dislodged, cable portion 34' pulls the bottom of net 30 out of its container. Here it can be seen that the upper leading cable portion 34 is carried above gate 22, whereas the aft upper portion 40 is also carried above the walls 14 and 16 as indicated.

Figure 6:
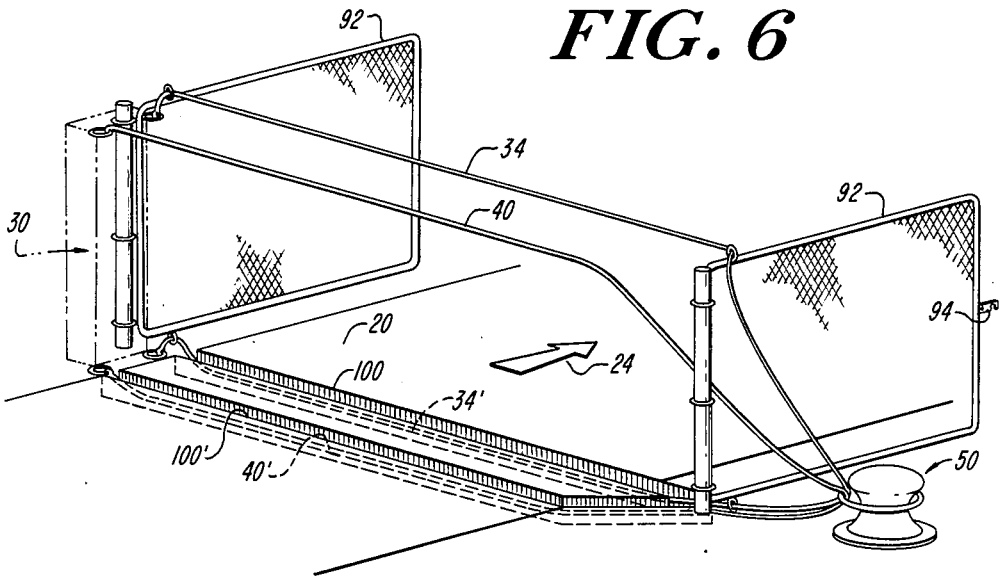
FIG. 6 is a diagrammatic illustration of the gate of FIG. 5 illustrating the opening of the gate to permit normal vehicle traffic between the upper and lower cables.

Referring to FIG. 6, with gates 92 open, a vehicle may proceed through the gate structure, with cable portions 34 and 40 being above any vehicle which is moving down the driveway, whereas cable portions 34' and 40' are located in channels 100 and 100' respectively which are embedded in driveway 20. In this illustration, net 30 is shown in a folded position to the left of the driveway.

It will be appreciated that gate portions 92 need not be of a very heavy nature so that they can be closed quickly and locked via latch 94, assuming enough advanced warning for an approaching vehicle. It is the purpose of the subject net-catching structure and momentum change capstan that any gate structure may be made so light that it can be closed extremely rapidly as opposed to the heavy gate structures which were thought to be necessary. The heavy gate structures were necessitated, it was thought, because of the mass of vehicles involved which would seek to penetrate the gate structure.

Figure 7:
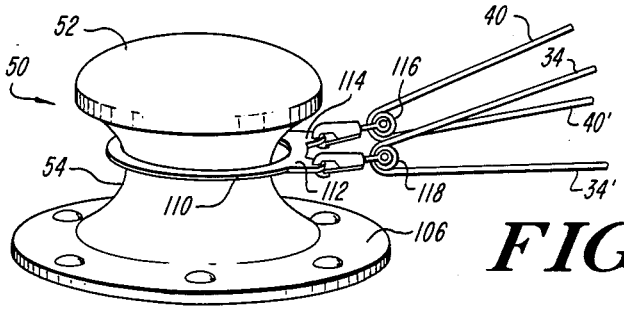
FIG. 7 is a diagrammatic illustration of a capstan including a yoke or collar having eyelets and pulleys, with the various cables going around the separate pulleys and the yoke functioning to swing around the capstan body.

Referring now to FIG. 7 the capstan 50 may as usual include a thimble like shape with the aforementioned top 52 and a smooth inner surface 54 about which the aforementioned cables may pass. The capstan in this Figure is shown to have a base portion 106 and includes in this embodiment ring 51 as a collar generally illustrated by reference character 110 which surrounds surface 54 and contains two eyelets 112 and 114 to which pulleys 116 and 118 are attached. Through these pulleys pass cables 34, 34' and 40, 40', with the pulleys serving to provide for movement of the cables back and forth around the pulleys to adjust changes in the length of the upper and lower cable portions between the top and bottom of the net, whereas collar 110 serves the purpose of retaining the cables about the capstan since collar 110 cannot slip off past capstan head 52.

Figure 8:
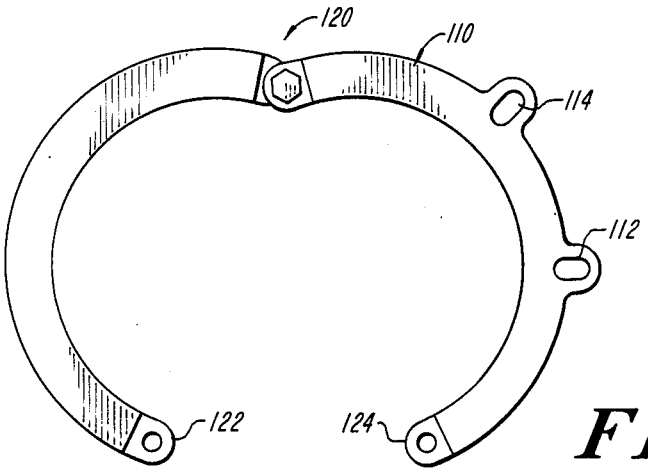
FIG. 8 is a top view of the yoke or collar of FIG. 7, showing eyelets which may be used with or without pulleys.

Referring to FIG. 8 collar 110 may be of a jointed configuration as illustrated by bolt and pivot point 120, with the collar being clamped at its ends 122 and 124 with suitable bolting means around the capstan. Here eyelets 112 and 114 may be of such rigid structure and of such smoothness that the cables may pass through eyelets 112 and 114 without the aid of pulleys 116 and 118 of FIG. 7.

It will be appreciated that the purpose of collar 110 is to prevent cables from slipping out over the top of capstan during a high impact collision, with the collar being sufficiently strong to prevent the cables from breaking away from the capstan.

Figure 9:
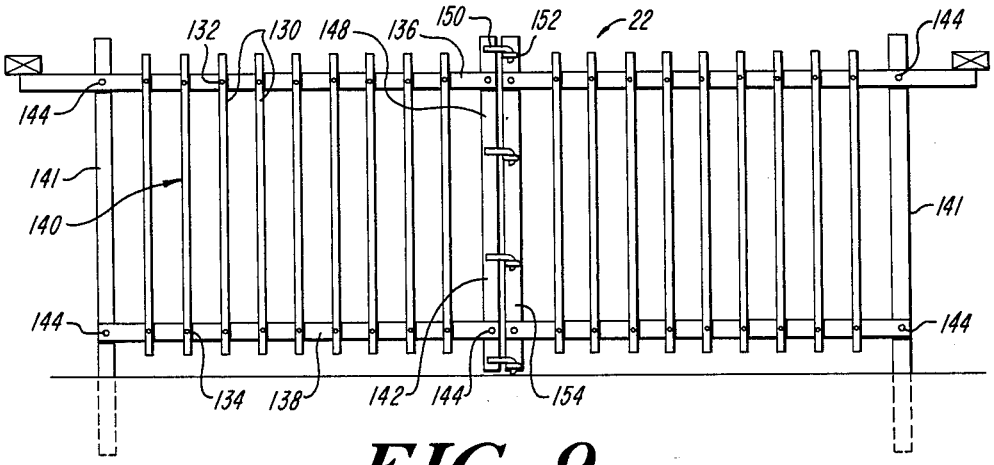
FIG. 9 is a diagrammatic illustration of one embodiment of a light-weight, break-away gate, illustrating a light-weight gate structure which may be easily and quickly raised and lowered, with interlocking eyelets and rigid hook structures.

Referring now to FIG. 9 in one embodiment, the gate structure 22 may take on a flexible parallelogram configuration with vertically rising members 130 hingedly attached at points 132 and 134 to respective interconnect members 136 and 138. The outer portion of gate 140 is hingedly attached to an upright stancion 141 at points 144 and to an inner upstanding member 148, again at points 144.

Here the two sides of the gate are joined together by a hook 150 engaging an eyelet 152 with the hook being secured to upstanding member 148 and with the corresponding eyelet being rigidly attached to upstanding member 154 of the opposing gate structure, such that when the gates are lowered, the hook and eyes are engaged thereby to prevent the opening of the gate. They are also of sufficient numbers so as to prevent an impacting vehicle from bursting the gate structure and thereby avoiding the net. The hook and eye structure is illustrated in FIG. 10 in which hook 150 is illustrated as having an inwardly turned end 151 within eyelet 152, portions of the upstanding members 148 and 154 being as illustrated.

Figure 11:
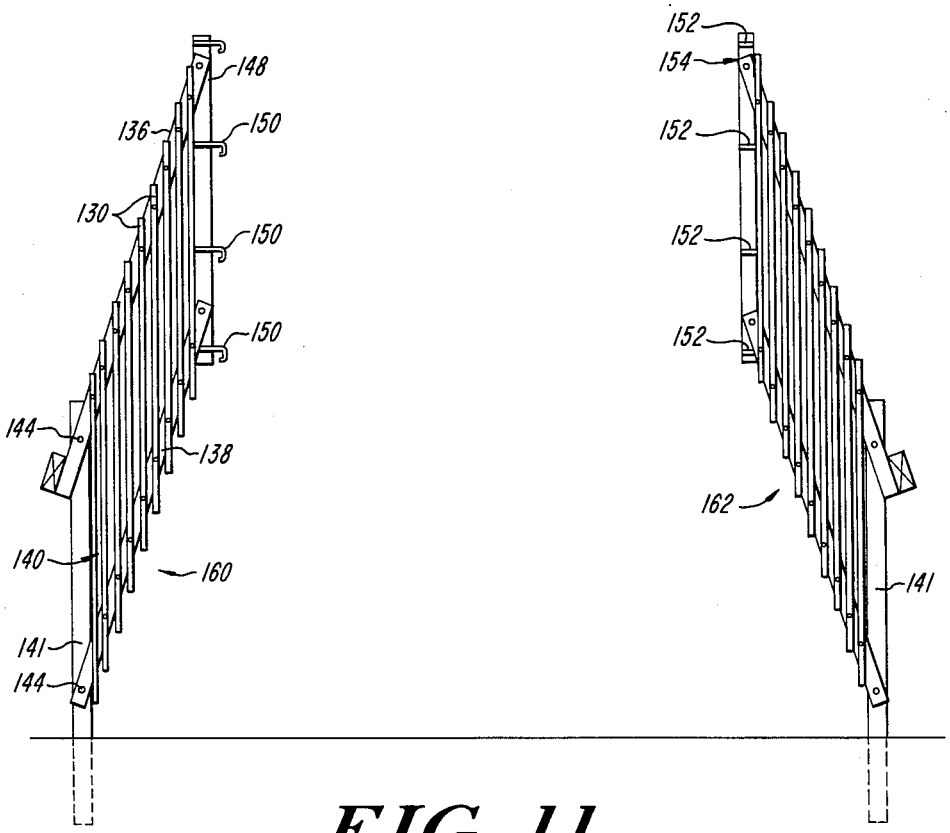
FIG. 11 is a diagrammatic illustration of the gate of FIG. 9 raised in its parallelogram form; and, FIG. 12 is a diagram of a slideable gate which comes out of its track upon impact by a vehicle.

Referring now to FIG. 11, gate portions 160 and 162 are shown in their uplifted position, in which the gates with their upstanding members 130 and their now angled interconnect members 136 and 138 occupying the position shown to permit passage of vehicular traffic through the gateway. It will be noted that members 136 and 138 are pivoted at points 144 on their respective stancions 141, with hooks 150 downwardly projecting as illustrated so as to be able to communicate with corresponding eyelets 152 in gate 162.

Referring now to FIG. 12, for sliding gates, the cables are contained in upper and lower channels and do not move relative to each other during the sliding of the gates. Here gate 22 may be of a sliding structure such as illustrated at 170, in which the sliding gate is translatable as indicated by double ended arrow 172, with the gate being supported from the top via channel 174 on which roller assemblies 176 roll on a flange 178 thereof. The gate is which that upon impact from the direction of arrow 180, the gate carries in the direction of arrow 180 such that the rollers and the cables come out of channel 174 which is opened rearwardly. This carries the upper cable portions 34 and 40 in the direction of arrow 182, it being understood that cable portion 40 is coupled to the gate structure 170 via a fixed link 184 which has at its other end an eyelet 186 which surrounds a round bar 188 on gate structure 170, such that the gate may move in the direction of double ended arrow 172, with bar 188 moving in the direction of double ended arrow 190 without moving cable portion 34 or 40.

This is likewise the case for the bottom of gate 170 which has a bar 192, with links 194 and 196 surrounding cable 34' and bar 192 simultaneously. Link 196 is joined to bar 192 at point 200, whereas link 194 is joined to cable 34' at point 202. It will be appreciated that cable portions 34' and 40' are carried in channels 204 and 206 which are within driveway 20.

Upon impact of a vehicle in the direction of arrow 180, the cables jump out of their respective channels along with gate 170 so as to carry the appropriate cables and the net with the gate.

This provides for a slideable gate assembly, in which the gate may be slid backwards and forwards without moving the respective cables but, which carries the cables with it when the gate is forced rearwardly by virtue of impact with a vehicle, thereby to pull the net previously described out of its container.

Having above indicated a preferred embodiment of the present invention, it will occur to those skilled in the art that modifications and alternatives can be practiced within the spirit of the invention. It is accordingly intended to define the scope of the invention only as indicated in the following claims.

I claim:

1. Apparatus for arresting vehicles progressing down a driveway through a gateway across said driveway, comprising:

at least two cables;

a net adapted to entrap a vehicle passing through said gateway from one side thereof, said net having corners, with predetermined pairs of corners joined together with one of said cables;

a capstan offset to one side of said driveway, the cables joining predetermined corners of the net being connected to the capstan;

means for deploying said net around a vehicle as said vehicle enters said gateway, with said capstan and said cables swinging said vehicle in a substantially circular path away from its original direction along said driveway; and, barrier means positioned to one side of said driveway in said substantially circular path, whereby the netted vehicle is caused to crash against said barrier means.

2. The apparatus of claim 1 wherein said net deployment means includes net storage means and a break-away gate means originally disposed across said gateway, said gate means having at least a portion thereof attached a portion of the cables attached to said net, such that upon impact of a vehicle with said break-away gate means, said net is carried around said vehicle, having been pulled out of said net storage means by virtue of the movement of said break-away gate means.

3. The apparatus of claim 2 wherein said storage means includes container means to one side of said driveway for containing said net in a collapsed condition, whereby said net is pulled out of said container means upon impact of said vehicle with said break-away gate means.

4. The apparatus of claim 2 wherein said barrier means includes a reinforced mound of earth.

5. The apparatus of claim 2 wherein said gate means includes a slideable gate.

6. The apparatus of claim 2 wherein said gate means includes a swingable gate.

7. The apparatus of claim 2 wherein said gate means includes two swingable portions joined at the center thereof.

8. The apparatus of claim 2 wherein said gate means includes moveable parallelograms of light-weight structure.

9. The apparatus of claim 1 wherein said capstan includes collar means and means for joining said cables to said collar means, whereby said cables do not slip off of said capstan upon impact of said vehicle.

10. The apparatus of claim 1 wherein said barrier means is positioned such that an impacting vehicle, upon impact, blocks said driveway.

11. The apparatus of claim 1 wherein said cables are fixed to said capstan to cause a change in length of said cables during vehicular travel as said cables wrap around said capstan.

* * * * *